US009947181B2

(12) United States Patent
Bae

(10) Patent No.: US 9,947,181 B2
(45) Date of Patent: Apr. 17, 2018

(54) SYSTEM AND METHOD FOR GENERATING SET OF LOTTO NUMBERS BY USING HASH CODES

(71) Applicant: Young Hyun Bae, Incheon-si (KR)

(72) Inventor: Young Hyun Bae, Incheon-si (KR)

( * ) Notice: Subject to any disclaimer, the term of this patent is extended or adjusted under 35 U.S.C. 154(b) by 0 days.

(21) Appl. No.: 15/033,852

(22) PCT Filed: Sep. 23, 2014

(86) PCT No.: PCT/KR2014/008844
§ 371 (c)(1),
(2) Date: May 2, 2016

(87) PCT Pub. No.: WO2015/064914
PCT Pub. Date: May 7, 2015

(65) Prior Publication Data

US 2016/0253862 A1 Sep. 1, 2016

(30) Foreign Application Priority Data

Nov. 1, 2013 (KR) ..... 10-2013-0132497

(51) Int. Cl.
*G07F 17/32* (2006.01)

(52) U.S. Cl.
CPC ..... *G07F 17/329* (2013.01)

(58) Field of Classification Search
CPC ..... G07F 17/329; G07F 17/32
See application file for complete search history.

(56) References Cited

U.S. PATENT DOCUMENTS 6,934,846 B2 * 8/2005 Szrek ..... G07C 15/006 380/251

FOREIGN PATENT DOCUMENTS

KR 10-2013-0009356 1/2013
KR 10-2013-0093446 8/2013

OTHER PUBLICATIONS

"Owl-Networks software distribution page", Aug. 9, 2012 <URL: http://www.nightowl.pe.kr/software/calcfilehash>.
"Owl-Networks software distribution page", Aug. 9, 2012 <URL: http://www.nightowl.pe.kr/software/lottonum>.
WIPO, International Search Report of PCT/KR2014/008844 dated Jan. 9, 2015.

* cited by examiner

*Primary Examiner* — Omkar Deodhar
(74) *Attorney, Agent, or Firm* — Lex IP Meister, PLLC

(57) ABSTRACT

The present disclosure provides a system and method for generating a set of lotto numbers using hash codes. The method includes receiving multimedia information containing a desired content from a user, converting the received multimedia information to hash codes, and generating a set of lotto numbers based on the converted hash codes.

6 Claims, 3 Drawing Sheets

SYSTEM AND METHOD FOR GENERATING SET OF LOTTO NUMBERS BY USING HASH CODES

CROSS-REFERENCE TO RELATED APPLICATION

This application claims the benefit of Korea Patent Application No. 10-2013-0132497 filed on Nov. 1, 2013, the entire content of which is incorporated herein by reference for all purposes as if fully set forth herein.

BACKGROUND

Field of the Present Disclosure

The present disclosure relates to a method for generating a set of lotto numbers, and more particularly, a method and system for generating a set of lotto numbers via conversion of user-input multimedia information to hash codes.

Discussion of the Related Art

The lottery ticket is a ticket with a certain size with specific numbers or specific marks thereon for sales. When the specific numbers or specific marks match with winning numbers or marks, the ticket owner wins predetermined money. The total sales incomes of the lotteries should exceed a sum of the predetermined money and general overheads. Types of the lottery may include a drawing lottery, lotto, instant lottery, number game, sport lottery, etc. Based on a participation manner of the lottery buyer, the lottery may include a pre-printed lottery type where winning numbers or symbols are pre-printed on the ticket, and a post-selection lottery type where the buyer selects winning numbers or symbols on his/her own in buying the ticket. The former type includes a drawing lottery and instant lottery. The latter type includes the lotto, number game, and sport lottery.

The lotto available from this country has a winning candidate set of six lotto numbers which is selected by the buyer from numbers 1 to 45. When the winning candidate set matches with a winning set of six lotto numbers which should be fairly drawn, a grade is determined based the number of matching numbers and a corresponding money is given to a winning lottery owner.

Regarding the lotto, the probability of matching of all of the 6 numbers from the numbers 1 to 45 may amount to 1/8,000,000. That is, the winding probability may be very low. The previous lotto sales system provides numbers selected by a prediction computer or in accordance with a fortune teller instead of the buyer directly selecting desired numbers.

The previous method for generating the set of lotto numbers may include selecting a winning candidate set of numbers based on analysis of previously winning numbers using statistics. Further, the computer may select randomly a winning candidate set of numbers. This random selection shall not be analyzed using current techniques.

Further, the previous method for generating the set of lotto numbers may employ "I Ching" (chinese: 易經) or the Classic of Changes to select a winning candidate set of numbers. This theory may be based on the fact that a specific person has a specific destiny. However, this theory may be realistic. In this connection, because the specific person has the specific destiny of winning the lotto, there is no need to select the winning candidate set of numbers intentionally.

SUMMARY

Technical Challenges

From consideration of the above, the present disclosure is aimed to provide a system for generating a set of lotto numbers, the system being configured to receive multimedia information containing a desired content from a user, to convert the received multimedia information to hash codes, and to generate a set of lotto numbers based on the converted hash codes.

Further, the present disclosure is aimed to provide a method for generating a set of lotto numbers, the method including receiving multimedia information containing a desired content from a user, converting the received multimedia information to hash codes, and generating a set of lotto numbers based on the converted hash codes.

However, the present disclosure is not limited to the above in terms of aims thereof. Another aims as not mentioned above may be apparent to the skilled person to the art on reading the present disclosure.

Technical Solutions

In an aspect of the present disclosure, there is provided a system for generating a set of lotto numbers using hash codes, the system comprising: a server configured to receive multimedia information containing a desired content via menu or key manipulation by the user, to convert the received multimedia information to hash codes, to generate a set of six lotto numbers based on the converted hash codes, and to send the generated lotto numbers to a user terminal; and a database configured to store therein the generated lotto numbers and the multimedia information.

In one embodiment, when receiving non-text information including an image, voice or moving picture, the server is configured to convert the non-text information to a text using Base 64.

In one embodiment, the server is configured to one-way encode the user-input text using MD5 (Message-Digest algorithm 5) to create the hash code.

In one embodiment, the server is further configured to determine the number of characters of a single hash code as a single lotto number when the number of the characters of the hash code is smaller than or equal to 45.

In one embodiment, the server is further configured to determine as the lotto number a remainder resulting from division of the number of the characters of the hash code by 45 when the number of the characters of the converted hash code is larger than 45; and determine 45 as the lotto number when the number of the characters of the hash code is larger than 45, and the remainder is 0.

In one embodiment, when a single lotto number is generated, the server is configured to add a predetermined value to the user-input text to create a new text, and to convert the new text to a new hash code, and to generate a new lotto number based on the new hash code.

In an aspect of the present disclosure, there is provided a method for generating a set of lotto numbers using hash codes, the method comprising: (a) receiving multimedia information containing a desired content via menu or key manipulation by the user; (b) converting the received multimedia information to hash codes, and generating a set of six lotto numbers based on the converted hash codes; and (c) sending the generated lotto numbers to a user terminal.

In one embodiment, upon receipt of non-text information including an image, voice or moving picture, the (b) comprises converting the non-text information to a text using Base 64.

In one embodiment, the (b) comprises one-way encoding the user-input text using MD5 (Message-Digest algorithm 5) to create the hash code.

In one embodiment, the generation of the lotto number comprises determining the number of characters of a single hash code as a single lotto number when the number of the characters of the hash code is smaller than or equal to 45.

In one embodiment, the generation of the lotto number comprises determining as the lotto number a remainder resulting from division of the number of the characters of the hash code by 45 when the number of the characters of the converted hash code is larger than 45; and determining 45 as the lotto number when the number of the characters of the hash code is larger than 45, and the remainder is 0.

In one embodiment, when a single lotto number is generated, the (b) comprises adding a predetermined value to the user-input text to create a new text, and converting the new text to a new hash code, and generating a new lotto number based on the new hash code.

Effect of Present Disclosure

In accordance with the present disclosure, the user may obtain a set of lotto numbers meaningful to the user by using the system and method including receiving multimedia information containing a desired content from a user, converting the received multimedia information to hash codes, and generating a set of lotto numbers based on the converted hash codes.

BRIEF DESCRIPTIONS OF THE DRAWINGS

DETAILED DESCRIPTIONS

Figure 1:
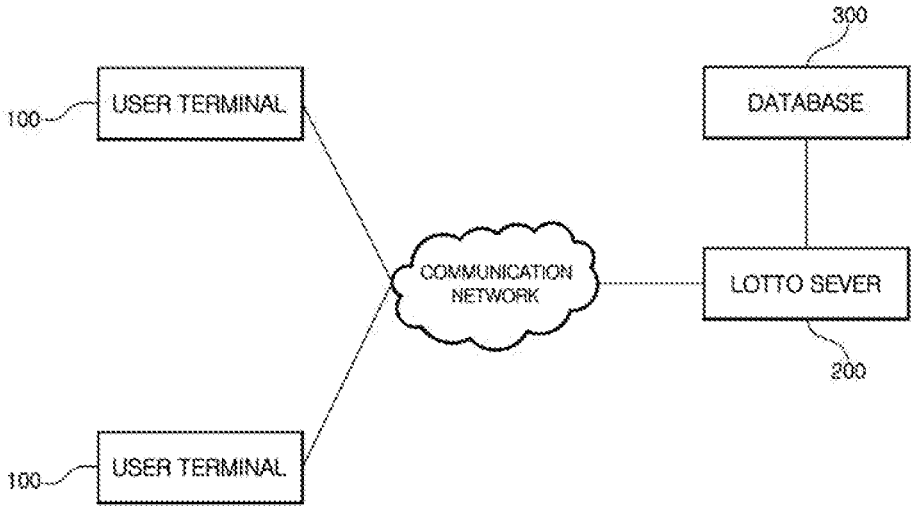
FIG. 1 illustrates a schematic view of a system for generating a set of lotto numbers in accordance with one embodiment of the present disclosure.

Hereinafter, a system and method for generating a set of lotto numbers using a hash code in accordance with an embodiment of the present disclosure will be described in details with reference to attached drawings. This description will focus on contents related to operations and effects in accordance with the present disclosure.

Further, when describing elements in the present disclosure, the same elements may be designated with the same reference numerals thorough the drawings. Otherwise, the same elements may be designated with different reference numerals thorough the drawings. In this case, however, a single certain element is not intended to have different functions between embodiments, or to have the same function between embodiments. That is, a function of each element is based on a description of the element in an associated embodiment.

The present disclosure provides a novel method for generating a set of lotto numbers including receiving multimedia information for example, an image, moving picture, voice, text, etc. containing a desired content from the user, converting the received multimedia information to hash codes, and generating the set of lotto numbers based on the converted hash codes, wherein the set of lotto numbers includes six lotto numbers.

FIG. 1 illustrates a schematic view of a system for generating a set of lotto numbers in accordance with one embodiment of the present disclosure.

As shown in FIG. 1, the system for generating a set of lotto numbers in accordance with one embodiment of the present disclosure includes a user terminal 110, a sever or lotto server 120, and a database 130.

The user terminal 110 may be used by the user to connect to the lotto server 120 via a wireless or wired communication, to input multimedia information containing a desired content thereto into the lotto server via menu or key manipulation by the user. The user terminal 110 may receive a set of lotto numbers generated based on the multimedia information.

In this connection, the user terminal 110 may communicate in wired or wireless manner, and may include, but not limited to, a smart-phone, a tablet PC, a notebook, a desktop personal computer, etc.

The lotto server 120 may be configured to receive the multimedia information containing a desired content from the user.

The lotto server 120 may be configured to convert the user-input multimedia information to hash codes, and to generate a set of six lotto numbers based on the converted hash codes.

The multimedia information may include a text received from the user. However, the present disclosure is not limited thereto. For example, the multimedia information may include an image, voice, moving picture, etc.

The lotto server 120 may be configured to convert non-text based information, when receiving the same, to a text. That is, when the lotto server 120 receives an image, voice, and/or moving picture, the server 120 may convert the received image, voice, and/or moving picture to a text using Base 64. As used herein, the Base 64 may refer to a group of similar binary-to-text encoding schemes that represent binary data in an ASCII string format by translating it into a radix-64 representation. The Base 64 may be used by MIME (Multipurpose Internet Mail Extensions), where data may be represented as four 7 bits ASCII characters by division of the data on a 3-bytes basis, the 3-bytes consisting of four units, a single unit consisting of six-bits. That is, the Base 64 is a coding scheme used in sending an image or audio file via an e-mail. Thus, the Base 64 may be employed to convert binary data using 64 ASCII codes commonly such that the image or audio file is not corrupted or not invisible for sending thereof via an e-mail.

The lotto server 120 may be configured to one-way encode a text using MD5 (Message-Digest algorithm 5) to create a hash code. The MD5 may refer to a 128 bits cryptographic hash function. The MD5 may be designated as RFC 1321. The MD5 may be mainly employed for an integrity check to confirm whether a file or program is original.

In this connection, it may be preferable that a blank character is removed from the text prior to the one-way encoding of the text.

The lotto server 120 may be configured to create a single lotto number based on a single hash code. That is, the lotto server 120 may be configured to determine the number of characters of the hash code as the lotto number when the number of the characters of the converted hash code is smaller than or equal to 45, and to determine as the lotto number a remainder resulting from division of the number of the characters of the converted hash code by 45 when the number of the characters of the converted hash code is larger than 45.

In this connection, the lotto server 120 may be configured to determine 45 as the lotto number when the number of the characters of the converted hash code is larger than 45, and the remainder resulting from division of the number of characters of the converted hash code by 45 is 0.

The lotto server 120 may be configured to repeat the above process until a set of total 6 different lotto numbers is created. In this connection, whenever a single lotto number is created, a predetermined value is added to the text received from the user, which, in turn, is converted to a new hash code. Thus, a new lotto number is created based on the new hash code.

The lotto server 120 may be configured to send the generated set of lotto numbers to the user terminal 110 using a user account for a certain website, an email, and/or a text message, etc.

The database 130 may be configured to store therein the generated set of lotto numbers and the associated multimedia information.

Figure 2:
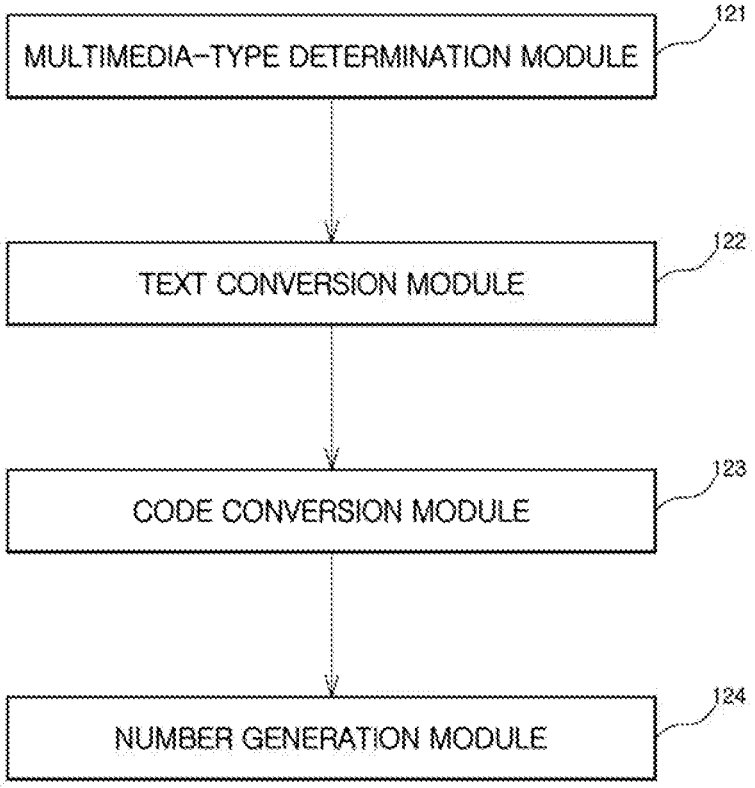
FIG. 2 illustrates a detailed configuration of a controller in accordance with one embodiment of the present disclosure.

FIG. 2 illustrates a detailed configuration of a controller in accordance with one embodiment of the present disclosure.

As shown in FIG. 2, the lotto server 120 in accordance with the present disclosure may include a multimedia-type determination module 121, text conversion module 122, a code conversion module 123, and a number generation module 124.

The multimedia-type determination module 121 may be configured to determine whether the user-input multimedia information is or is not a text. That is, the multimedia-type determination module 121 may be configured to determine whether the user-input multimedia information is the text or non-text multimedia information such as an image, voice, or moving picture.

The text conversion module 122 may be configured to convert to a text the non-text multimedia information such as an image, voice, or moving picture when the user-input multimedia information is the non-text multimedia information.

In this connection, the text conversion module 122 may employ the Base 64 for the conversion.

The code conversion module 123 may be configured to convert the user-input text to the hash code. In this connection, the code conversion module 123 may employ the MD5 for the one-way encoding of the text to generate the hash code.

The number generation module 124 may be configured to generate a set of six lotto numbers based on the converted hash codes. After generating a single lotto number based on the converted hash code, the numbers generation module 124 may be configured to add a predetermined value to the text to create a new text, and then to convert the new text to a new hash code, and to create a new lotto number based on the converted hash code.

The number generation module 124 may be configured to repeat the above process until a set of six lotto numbers is generated.

Figure 3:
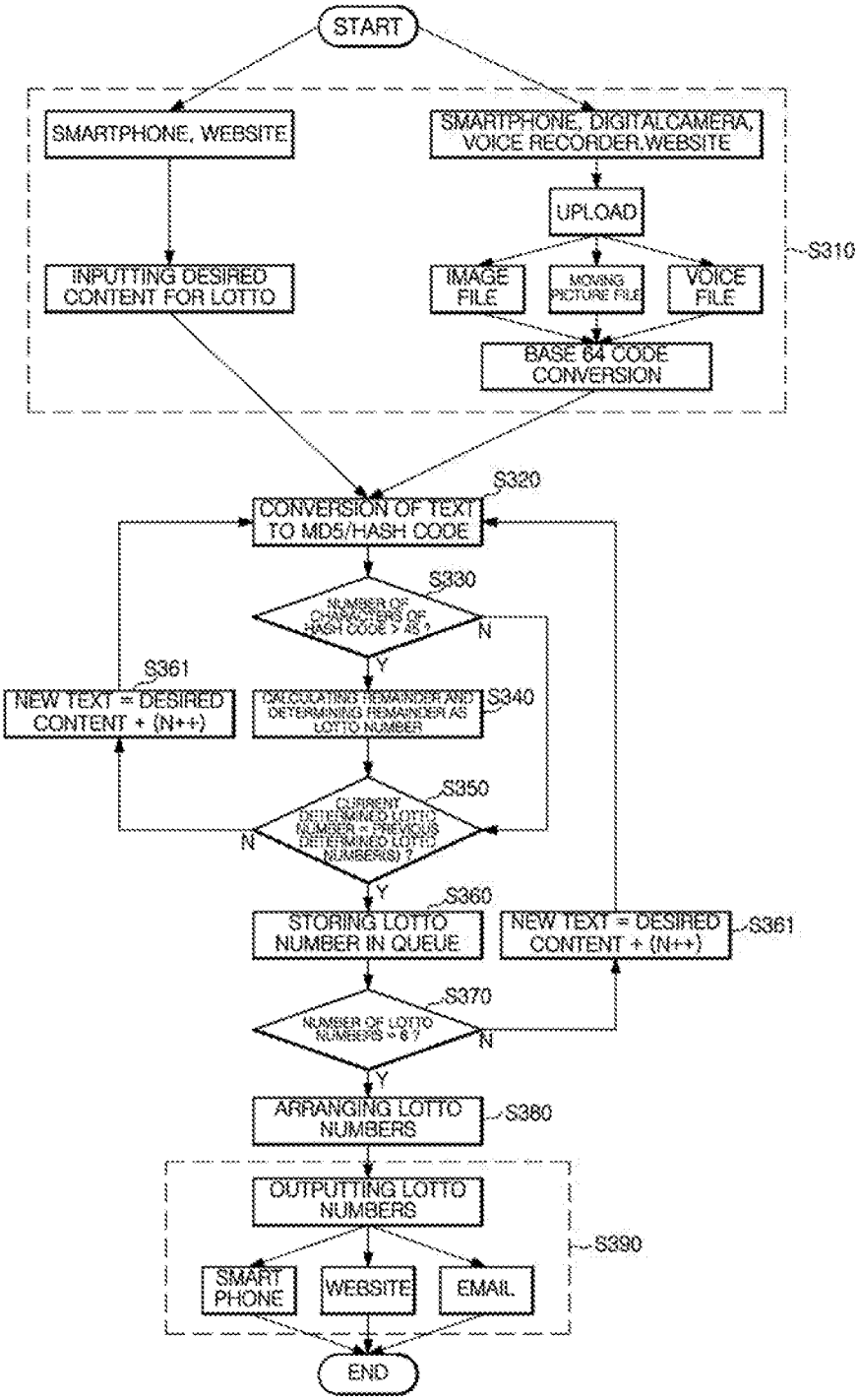
FIG. 3 illustrates a flow view of a method for generating a set of lotto numbers in accordance with one embodiment of the present disclosure.

FIG. 3 illustrates a flow view of a method for generating a set of lotto numbers in accordance with one embodiment of the present disclosure.

As shown in FIG. 3, the system for generating the set of lotto numbers in accordance with the present disclosure (hereinafter, referred to as "lotto number generation system") may receive the multimedia information for example, an image, voice, moving picture, and/or text from the user (S310).

In this connection, when the received information is non-text information such as an image, voice, moving picture, the lotto number generation system may convert the non-text information to a text.

In this connection, the lotto number generation system may employ the Base 64 for the conversion to the text.

Subsequently, the lotto number generation system may convert the text to a hash code (S320). In this connection, the lotto number generation system may one-way encode the text using the MD5 to create the hash code.

Thereafter, the lotto number generation system may determine whether the number of the characters of the generated hash code is larger than 45 (S330). In this connection, the lotto number generation system may determine the number of the characters of the generated hash code as a single lotto number when the number of the characters of the generated hash code is smaller than or equal to 45.

Otherwise, when the number of the characters of the generated hash code is smaller than or equal to 45, the lotto number generation system may determine as a single lotto number the remainder resulting from division of the number of the characters of the converted hash code by 45. In this connection, the lotto number generation system may determine 45 as the lotto number when the number of the characters of the converted hash code is larger than 45, and the remainder resulting from division of the number of characters of the converted hash code by 45 is 0.

After this, the lotto number generation system may determine whether a current determined lotto number matches with a previous determined lotto number (S350). In this connection, when the current determined lotto number does not match with the previous determined lotto number, the lotto number generation system may store the current determined lotto number in a memory (S360).

Otherwise, when the current determined lotto number does matches with the previous determined lotto number, the lotto number generation system may add a predetermined value to the user-input text and then may repeat the process prior to the S361.

Next, when the single lotto number is stored in the memory, the lotto number generation system may determine whether the total number of the lotto numbers stored in the memory reaches a predetermined number, that is, 6 (S370). In this connection, when the total number of the lotto numbers stored in the memory reaches the predetermined number, that is, 6, the lotto number generation system may arrange the set of lotto numbers (S380), and, then, send the arranged six lotto numbers to the user terminal, which, in turn, may be displayed on a display module of the user terminal (S390).

Otherwise, when the total number of the lotto numbers stored in the memory is below the predetermined number, that is, 6, the lotto number generation system may add the predetermined value to the user-input text and then repeat the above process prior to the S361.

As will be appreciated by one skilled in the art, the present disclosure may be embodied as a method, system, or computer program product. Accordingly, the present disclosure may take the form of an entirely hardware implementation, an entirely software implementation (including firmware, resident software, micro-code, etc.) or an implementation combining software and hardware aspects that may all generally be referred to herein as a "circuit," "module" or "system." Furthermore, the present disclosure may take the form of a computer program product on a computer-usable storage medium having computer-usable program code embodied in the medium. Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The implementation was chosen and described in order to best explain the principles of the disclosure and the practical application, and to enable others of ordinary skill in the art to understand the disclosure for various implementations with various modifications as are suited to the particular use contemplated. Having thus described the disclosure of the present application in detail and by reference to implementations thereof, it will be apparent that modifications and variations are possible without departing from the scope of the disclosure defined in the appended claims.

What is claimed is:

1. A system for generating a set of lotto numbers using hash codes, the system comprising:

a server configured to receive multimedia information containing a desired content via menu or key manipulation by the user, to convert the received multimedia information to hash codes, to generate a set of six lotto numbers based on the converted hash codes, and to send the generated lotto numbers to a user terminal; and a database configured to store therein the generated lotto numbers and the multimedia information, wherein the server is further configured to:

determine the number of characters of a single hash code as a single lotto number when the number of the characters of the hash code is smaller than or equal to 45;

determine as the lotto number a remainder resulting from division of the number of the characters of the hash code by 45 when the number of the characters of the converted hash code is larger than 45; and determine 45 as the lotto number when the number of the characters of the hash code is larger than 45, and the remainder is 0.

2. The system of claim 1, wherein when receiving non-text information including an image, voice or moving picture, the server is configured to convert the non-text information to a text using Base 64.

3. The system of claim 1, wherein when a single lotto number has been generated, the server is configured to add a predetermined value to the user-input text to create a new text, and to convert the new text to a new hash code, and to generate a new lotto number based on the new hash code.

4. A method for generating a set of lotto numbers using hash codes, the method comprising:

receiving multimedia information containing a desired content via menu or key manipulation by the user;

converting the received multimedia information to hash codes, and generating a set of six lotto numbers based on the converted hash codes; and sending the generated lotto numbers to a user terminal, wherein the generation of the lotto number comprises:

determining the number of characters of a single hash code as a single lotto number when the number of the characters of the hash code is smaller than or equal to 45;

determining as the lotto number a remainder resulting from division of the number of the characters of the hash code by 45 when the number of the characters of the converted hash code is larger than 45; and determining 45 as the lotto number when the number of the characters of the hash code is larger than 45, and the remainder is 0.

5. The method of claim 4, wherein upon receipt of non-text information including an image, voice or moving picture, the (b) comprises converting the non-text information to a text using Base 64.

6. The method of claim 4, wherein when a single lotto number have been generated, the (b) comprises adding a predetermined value to the user-input text to create a new text, and converting the new text to a new hash code, and generating a new lotto number based on the new hash code.

* * * * *